US007224322B1

(12) United States Patent
Ghaleb et al.

(10) Patent No.: US 7,224,322 B1
(45) Date of Patent: May 29, 2007

(54) BALLOON ANTENNA

(75) Inventors: Sam Ghaleb, Ridgecrest, CA (US); Floyd A. Kinder, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 29 days.

(21) Appl. No.: 11/177,649

(22) Filed: Jun. 30, 2005

(51) Int. Cl.
*H01Q 15/20* (2006.01)

(52) U.S. Cl. ..... 343/915; 343/912; 342/8; 342/10

(58) Field of Classification Search ..... 343/912, 343/915; 342/8, 10
See application file for complete search history.

(56) References Cited

U.S. PATENT DOCUMENTS

| | | | | |
|---|---|---|---|---|
| 2,814,038 | A * | 11/1957 | Miller | 343/757 |
| 2,913,726 | A * | 11/1959 | Currie | 343/872 |
| 3,671,965 | A * | 6/1972 | Rabenhorst et al. | 342/8 |
| 6,650,304 | B2 * | 11/2003 | Lee et al. | 343/915 |
| 6,963,315 | B2 * | 11/2005 | Gierow et al. | 343/872 |
| 2005/0179615 | A1 * | 8/2005 | Mrstik et al. | 343/915 |

* cited by examiner

*Primary Examiner*—Tan Ho
(74) *Attorney, Agent, or Firm*—Laura R. Foster

(57) ABSTRACT

A phased array balloon antenna having an inner membrane coupled to an outer membrane and a phased array antenna connected to an inner membrane. The phased array antenna transmits an energy towards a reflective film on the outer membrane, reflecting the energy outwards and illuminating an area smaller than that illuminated by the phased array alone.

12 Claims, 3 Drawing Sheets

BALLOON ANTENNA

STATEMENT REGARDING FEDERALLY SPONSORED RESEARCH OR DEVELOPMENT

The invention described herein may be manufactured and used by or for the government of the United States of America for government purposes without the payment of any royalties thereon or therefor.

BACKGROUND OF THE INVENTION

Large aperture antennas are needed in satellite based radars to focus a radar beam, due to the limitations on power available on the satellite. In order to place a large aperture antenna in space on a satellite the radar assembly has to be packaged to fit into the launch rocket as well as be assembled or unfolded in space. This is very difficult and prohibitive for large aperture phased arrays.

Phased array radar systems are preferred in space based applications due to the ability to electronically steer the array, thereby not requiring a movement of mass. Making a large phased array antenna that can be assembled or unfolded in space is very difficult task. There is a need to provide the effect and coverage of a large aperture phased array antenna while solving the problems of difficulty of installation in space and limited power supply.

DESCRIPTION OF THE EMBODIMENTS

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation. In the figures, the same reference numbers are used to identify the same components.

Embodiments of the invention include a phased array balloon antenna and a method for using the antenna. A phased array antenna system is placed on an inner membrane of a balloon. The outer membrane of the balloon has a reflective film suspended across a portion of it's volume or is lined with a reflective film. The phased array operates as a large aperture antenna by reflecting the radar energy or beam from the phased array antenna off the reflective film so that it has the same effect as if large aperture antenna was in use. This approach permits a very small phased array to operate as a large aperture phased array while utilizing loss power. A conventional phased array antenna coupled to a large reflector will operate for beaming purposes as a large phased array antenna. The balloon system shall be packed deflated and launched with a satellite and shall be deployed by inflating on arrival.

Figure 1:
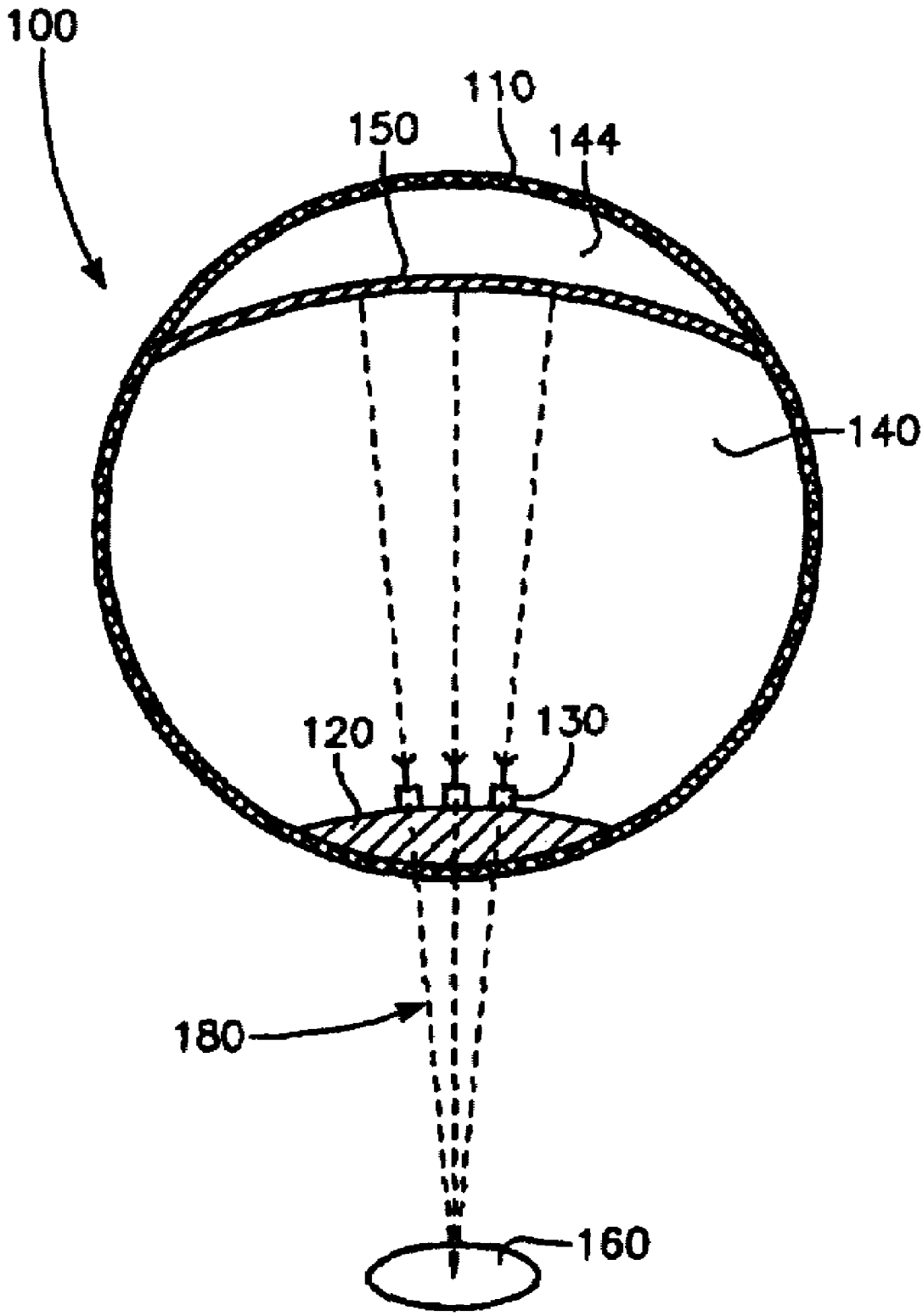
FIG. 1 illustrates a phased array balloon antenna for space based operation according to an embodiment of the invention.
Figure 2:
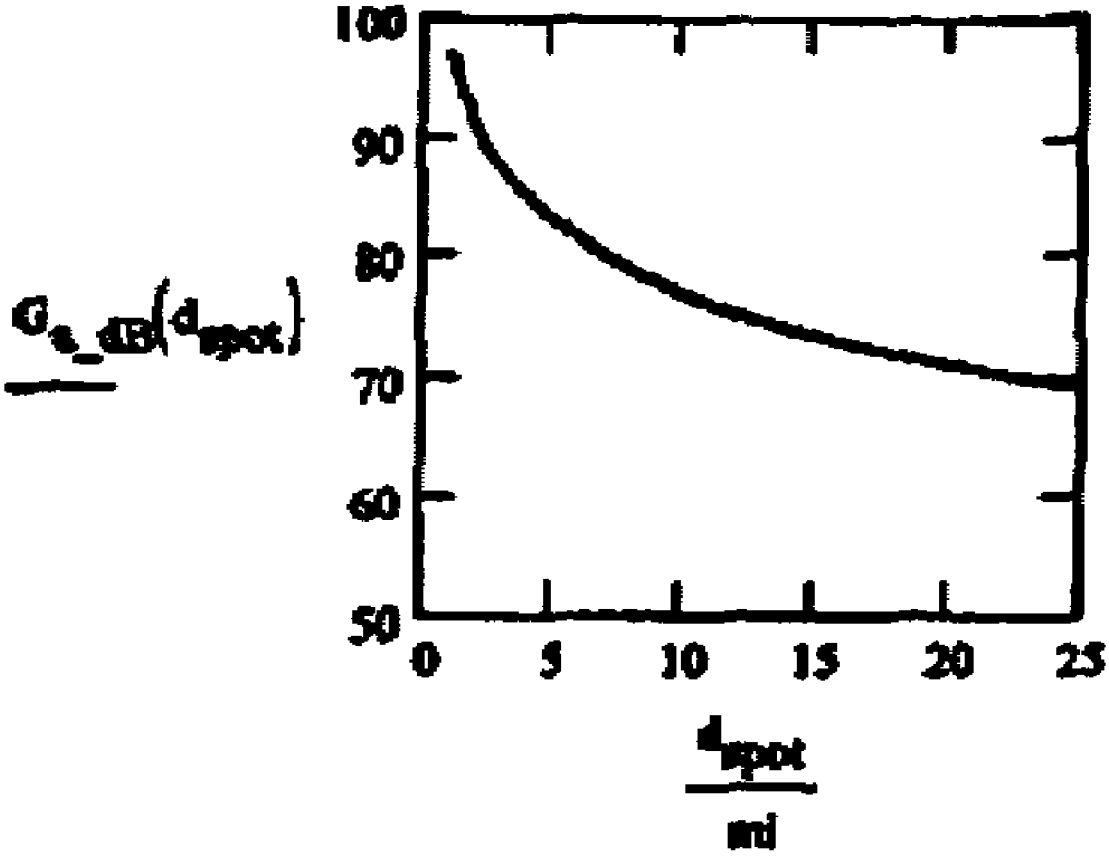
FIG. 2 is a diagram of $G_{a_dB}(d_{spot})$vs, $d_{max}$/mi.
Figure 3:
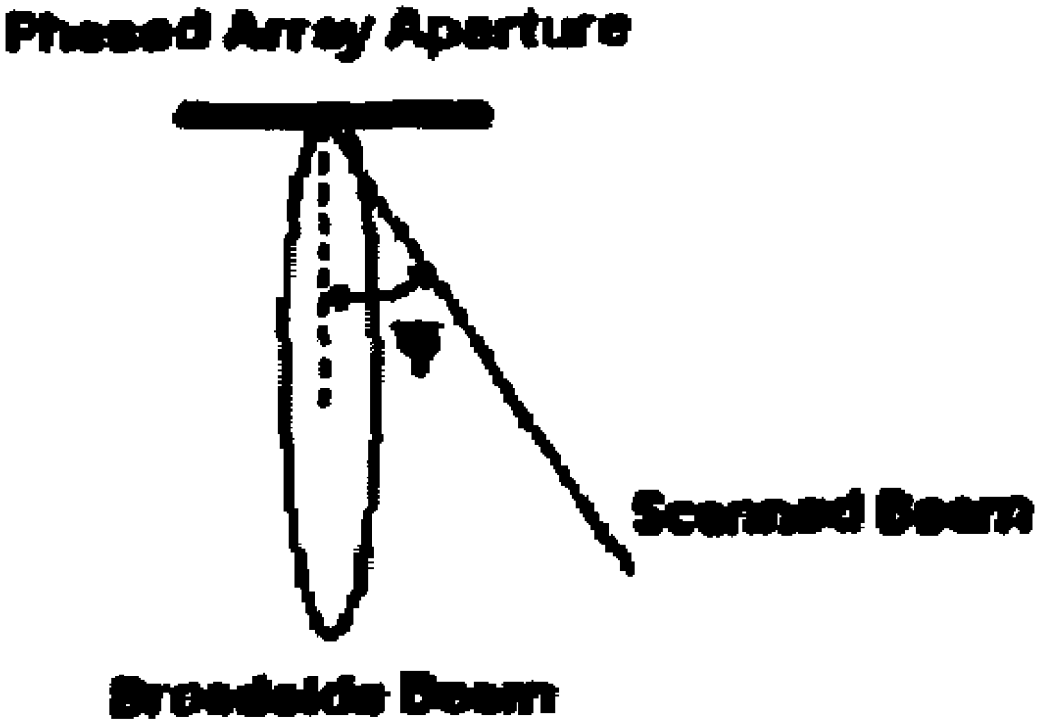
FIG. 3 is a diagram of a phased array aperture.

FIG. 1 illustrates a space based embodiment of the invention. A balloon antenna 100 is constructed of an inner membrane 120 and an outer membrane. 110. The outer membrane 110 is constructed so as to be inflatable and to hold a volume of gas. The inner membrane 120 supports a phased array antenna 130. The outer membrane 110 has a reflector film 150 suspended across a portion of the outer membrane's volume, having a curved shape determined by an inflation pressure differential between the large compartment 140 and the small compartment 144 on the opposite sides of the reflective film 150. The reflective film is constructed of a non-gas permeable material. A phased array antenna (represented by 130) is connected and mounted on the inner membrane 120. The phased array 130 is directed outwardly from the center of the balloon towards the inside curved surface of the reflective film 150. The reflective film 150 operates as a large aperture antenna and as the reflector for the phased array radar 130 system connected to the inner membrane 120.

The phased array radar system antenna 130 transmits an energy towards the reflective film 150, reflecting the energy from the reflective film 150 outwards and illuminating a target area smaller than the area (with more energy per unit area) that would be illuminated by the phased array antenna operating alone. The phased array 130 shall transmit radar energy towards the reflective film 150 on the outer membrane 110, reflecting the radar signal 180 onto the target area 160. The direction of the radar signal 180 is electrically steered by the phased array 130, which requires no moving parts, only a change in phase between the elements. It is noteworthy that since no mass is being relocated the phase array 130 is suitable for use on a satellite. The amplitude and phase of the radar energy is provided by the phased array 130. The effective curvature or shape can be adjusted smaller or larger as the circumstances required by adjusting the pressure differential between the large compact 140 and the small compartment 144. By adjusting the shape of the reflective film (thereby focusing the antenna), the limited power available on a space based radar can be concentrated in a desired area. Therefore, the phased array signal will have the effect on the target as if it were coming from a large aperture antenna. Other embodiments may be constructed utilizing additional reflective films and additional phased arrays within the balloon. In this way embodiments of the invention may be used for tracking and illumination of additional target areas.

Another embodiment of the invention includes a method for illuminating an area with radar energy including: providing a balloon antenna comprising at least one inner and an outer membrane, at least one phased array antenna connected each inner membrane, the outer membrane having at least one reflective film and being inflatable; transmitting a radar energy from each phased array antenna towards each reflective film; reflecting the radar energy outwards from the reflective film and illuminating a target area that is smaller than an area illuminated by the phased array antenna; and changing the inflation of at least one compartment within the outer membrane which changes the shape of the reflective films, thereby adjusting the target area illuminated by the phased array balloon antenna.

RESULTS OF SIMULATION

A calculated simulation was performed to evaluate the performance of an embodiment of the invention. The simulation assumed a radar illuminator in a geosynchronous orbit, having no detection requirements, as could be used as one part of a bistatic system. Based on an illuminated target area of 25 miles in diameter, the member of elements and array size can be found.

Constant and Units $$c := 3 \cdot 10^8 \cdot \frac{\text{m}}{\text{sec}} \text{ Speed of Light} \qquad \text{nmi}: = 1852 \text{ m}$$

$$f := 10 \cdot GH; \qquad \lambda := \frac{c}{f} \qquad \lambda = 0.03 \text{ m}$$

Gain vs. Spot Size

One of the major concerns when operating from geosynchronous orbit is controlling the illuminated area (spot) size on the ground, which determines the energy per unit area. As power in space is limited it is necessary to limit the illuminated area to maintain detectability.

$$d_{spot} := 1 \cdot \text{mi},\ 1.1 \cdot \text{mi}..25 \cdot \text{m} \quad d_g := 1,\ 1.1..25 \quad H_a := 22800$$

$$H_{alt} := 22800 \text{ m}$$

$$\theta_{3dB}(d_{spot}) : \frac{d_{spot}}{H_{alt}} \qquad \theta(d_s) := 2 \cdot \text{atan}\left(\frac{0.5 d_s}{H_a}\right)$$

$$D_{\text{main_ref}}(d_{spot}) := 1.27 \cdot \frac{\lambda}{\theta_{3dB}(d_{spot})}$$

$$\eta := 60\% \qquad A_{\text{main_ref}}(d_{spot}) := \frac{\pi \cdot (D_{\text{main_ref}}(d_{spot}))^2}{4}$$

$$A_e(d_{spot}) := A_{\text{main_ref}}(d_{spot}) \cdot \eta$$

$$G_a(d_{spot}) := \frac{4\pi}{\lambda^2} \cdot A_e(d_{spot}) \qquad G_{a_dB}(d_{spot}) := 10 \ \log(G_a(d_{spot}))$$

$$G_{a_dB}(5 \cdot \text{mi}) = 82.98$$

$$G_{a_dB}(10 \cdot \text{mi}) = 76.959$$

$$G_{a_dB}(15 \cdot \text{mi}) = 73.437$$

For 25 miles spot size:

$$G_{a_dB}(25 \cdot \text{mi}) = 69 \qquad \text{mil_rad} := \frac{\text{rad}}{1000}$$

$$A_{\text{main_ref}}(25 \cdot \text{mi}) = 948.265 \text{ m}^2 \qquad \mu\text{_rad} := 10^{-6} \cdot \text{rad}$$

$$D_{\text{main_ref}}(25 \cdot \text{mi}) = 948.265 \text{ m}^2$$

$$\theta_{3dB}(25 \cdot \text{mi}) = 0.063 \text{ deg} \qquad \theta_{3dB}(25 \cdot \text{mi}) = 1.096 \text{ mil_rad}$$

Assuming peak power needed for detection $$P_{peak} := 5000 \text{ watt} \quad N_{element} := \text{floor}\left(\frac{P_{peak}}{P_{element}}\right) \quad N_{element} = 625$$

$$P_{element} := 8 \cdot \text{watt}$$

Beam Pointing Resolution

The beam pointing resolution determines the amount of movement on the ground required to keep a target area illuminated by the receiver (such as an attack aircraft). For example, for the 25 mile diameter target area the phased array may move the illuminated area in steps of 5 or 10 miles.

$$N(s) := \text{floor}\left(\frac{D_{\text{main_ref}}(25 \cdot \text{mi})}{s}\right) \qquad \text{Number of Elements}$$

$$\theta_{BB} := \frac{50.8}{\left(\frac{D_{\text{main_ref}}(25 \cdot \text{mi})}{\lambda}\right)} \cdot \text{deg} \qquad \text{Broadside Beamwidth}$$

$$\psi := 1 \cdot \text{deg} \qquad S_{ground} := \psi \cdot H_{alt} \qquad S_{ground} = 397.935 \text{ m}$$

Translation on the Ground

The remaining calculations are based on basic design methodology of the phased array antenna based on the desired amount of beam translation on the ground. By defining the amount of beam step on the ground (translation), there is the ability to proceed with the design of a Cassegrain system. The calculations assume an F1 system wherein the diameter of the main reflector (reflector film) is the same as the focal length. Based on this the number of phase elements on the sub reflector is calculated gives a particular phase shifter, i.e. the number of bits in the phase shift.

$$S_{g_desired} := 20 \cdot \text{m} \quad S := \frac{\lambda}{2} \text{ element spacing}$$

$$\psi_\delta := \frac{S_{g\ desired}}{H_{alt}} \quad \psi_\delta = 877.193 \mu\text{_rad}$$

For a Cassegrain system the angle scanned by the subreflector is half the total angle scanned by the main reflector.

$$\Psi_{sr} := 1 \cdot \text{deg}$$

Angle off boresight for subreflector

For an F1 optical system the diameter at the main reflector is the same as the focal length.

$$D_{reflector} := 0.8 D_{\text{main_ref}}(25 \cdot \text{mi}) \quad D_{reflector} = 27.798 \text{ m}$$

$$\text{const}: 1.5$$

$$\text{focal}: \text{const} \cdot D_{reflector} \qquad \text{focal} = 41.697 \text{ m}$$

$$\theta_{BB} := \frac{D_{reflector}}{\text{focal}} \qquad \theta_{BB} = 38.197 \text{ deg}$$

$$\theta_B := \frac{\theta_{BB}}{\cos(\psi_{ST})} \quad \theta_B = 38.203 \text{ deg} \quad \text{Scanned beamwidth}$$

$$p := 7 \qquad \text{\# of bits of phase shifter}$$

$$\delta\theta(s) := \frac{9.0_B}{N(s) \cdot 2^P} \qquad \text{beam pointing resolution}$$

$$N_{elements} := \text{floor}\left(\frac{9 \cdot \theta_B}{\frac{\psi_s}{2} \cdot 2^P}\right) \quad N_{elements} = 106$$

$$N_{elements} \cdot \frac{\lambda}{2} = 1.59 \text{ m} \quad \text{Size of subreflector}$$

It is to be understood that the foregoing detailed description is exemplary and explanatory only and is not to be viewed as being restrictive of embodiments of the invention, as claimed. The invention is capable of other and different embodiments, and its several details are capable of modifications in various obvious respects, all without departing from the invention. Accordingly, the drawings and description are to be regarded as illustrative in nature, and not as restrictive. Thus the scope of this invention should be determined by the appended claims, drawings and their legal equivalents.

What is claimed is:

1. A phased array balloon antenna comprising:

at least one inner membrane coupled to an outer membrane;

at least one phased array antenna connected to each said inner membrane;

said outer membrane having at least one reflective film; said outer membrane being inflatable;

each said phased array antenna transmitting a radar energy towards each said reflective film, said radar energy being reflected outwards from said reflective film and illuminating at least one target area, wherein each said target area is smaller than an area illuminated by said phased array antenna; and a shape of each said reflective film changeable by inflation of at least one compartment within said outer membrane, thereby adjusting each said target area illuminated by said phased array balloon antenna.

2. The phased array balloon antenna of claim 1 wherein said balloon antenna is deployed on a satellite.

3. The phased array balloon antenna of claim 1 wherein each said inner membrane is located on a side of said outer membrane opposite of each said reflective film.

4. The phased array balloon antenna of claim 1 wherein each said inner membrane is inflatable.

5. The phased array balloon antenna of claim 1 wherein each said reflective film is suspended across a volume encompassed by said outer membrane.

6. The phased array balloon antenna of claim 1 wherein said shape of each said reflective film is changed by adjusting an inflation pressure differential between a small compartment and a large compartment on either side of each said reflective film within said outer membrane.

7. A method for illuminating an area with radar energy comprising:

providing a balloon antenna comprising at least one inner membrane and an outer membrane, at least one phased array antenna connected to each said inner membrane, said outer membrane having at least one reflective film; said outer membrane being inflatable;

transmitting a radar energy from each said phased array antenna towards each said reflective film, reflecting said radar energy outwards from each said reflective film and illuminating at least one target area, wherein each said target area is smaller than an area illuminated by each said phased array antenna; and changing a shape of each said reflective film by changing the inflation of at least one compartment within said outer membrane, thereby adjusting each said target area illuminated by said phased array balloon antenna.

8. The method of claim 7 wherein said balloon antenna is deployed on a satellite.

9. The method of claim 7 wherein each said inner membrane is located on a side of said outer membrane opposite of each said reflective film.

10. The method of claim 7 wherein each said inner membrane is inflatable.

11. The method of claim 7 wherein each said reflective film is suspended across a volume encompassed by said outer membrane.

12. The method of claim 7 wherein said changing a shape of each said reflective film is achieved by adjusting an inflation pressure differential between a small compartment and a large compartment on either side of each said reflective film within said outer membrane.

* * * * *